US007338394B2

(12) United States Patent
Harris

(10) Patent No.: US 7,338,394 B2
(45) Date of Patent: Mar. 4, 2008

(54) GOLF TEE

(75) Inventor: Richard M. Harris, 2029 N. Cleveland, Chicago, IL (US) 60614

(73) Assignee: Richard M. Harris, Chicago, IL (US)

( * ) Notice: Subject to any disclaimer, the term of this patent is extended or adjusted under 35 U.S.C. 154(b) by 11 days.

(21) Appl. No.: 11/293,998

(22) Filed: Dec. 5, 2005

(65) Prior Publication Data

US 2007/0129177 A1 Jun. 7, 2007

(51) Int. Cl.
*A63B 57/00* (2006.01)

(52) U.S. Cl. ..... 473/387

(58) Field of Classification Search ..... 473/387–403; D21/717, 718

See application file for complete search history.

(56) References Cited

U.S. PATENT DOCUMENTS 1,671,813 A * 5/1928 Clarke ..... 473/403
2,531,470 A * 11/1950 Rickard ..... 473/396
D201,890 S * 8/1965 Dreyfus ..... D21/718
3,347,551 A * 10/1967 Dreyfus ..... 473/257
3,448,984 A * 6/1969 Dreyfus ..... 473/257
D232,568 S * 8/1974 Brown ..... D21/717
3,947,027 A * 3/1976 Brown ..... 473/278
D376,182 S * 12/1996 Lusk ..... D21/718
D385,939 S * 11/1997 Suk ..... D21/794
5,738,598 A * 4/1998 Wu ..... 473/392
D431,849 S * 10/2000 MacDonald ..... D21/718
D439,944 S * 4/2001 Graham ..... D21/717
D491,990 S * 6/2004 Lu ..... D21/717
6,960,143 B2 * 11/2005 Sato ..... 473/387

* cited by examiner

*Primary Examiner*—Steven Wong
(74) *Attorney, Agent, or Firm*—McDonnell Boehnen Hulbert & Berghoff LLP

(57) ABSTRACT

A golf tee comprising a body and a head is described, wherein the head is elongated and grooved. The golf tee described herein provides directional trajectory to a golf ball upon impact with a golf club.

7 Claims, 1 Drawing Sheet

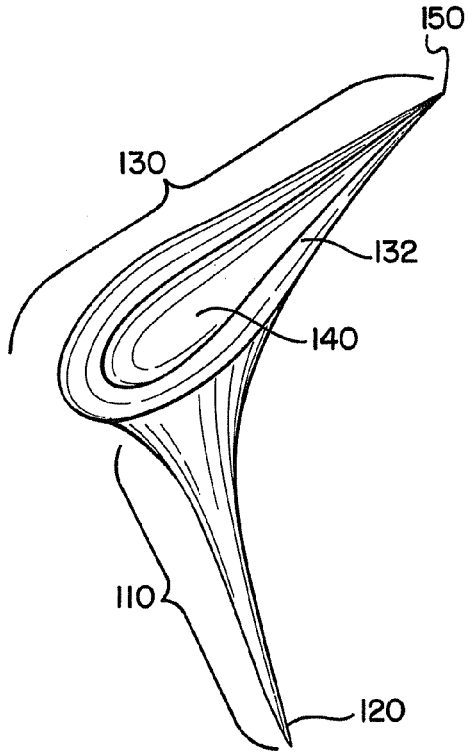
FIG. 1
FIG. 2
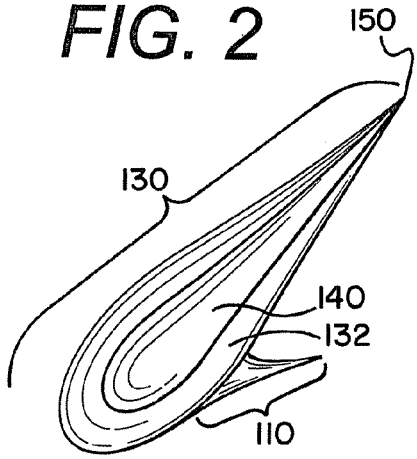
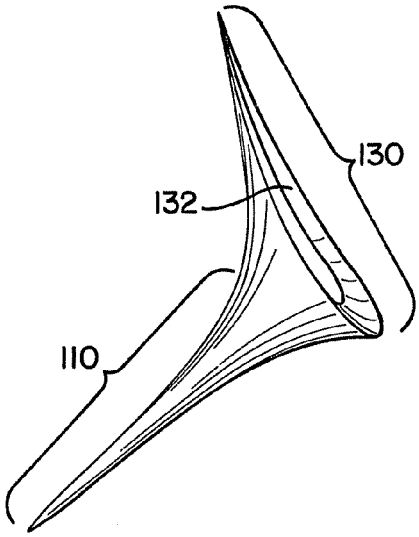
FIG. 3

GOLF TEE

BACKGROUND

1. Field

The application is in the field of sporting goods. In particular, the application relates to equipment for use in the game of golf.

2. Description of the Related Art

Golf is one of the most widely played sports activities in the United States. The game of golf is typically played on a course consisting of nine or eighteen holes. Each hole has a tee box that defines a starting location of that hole. At the tee box, a golfer places a golf ball and swings a golf club to strike the ball towards the designated green for that hole. It is permissible to use a golf tee to hold the golf ball in an elevated position at the tee box, before striking the ball with the golf club. The golf tee is pushed into the ground and the ball on is placed top of it. The rules of golf normally provide for the use of a golf tee in this manner for the first stroke of each hole.

The appearance and manufacture of conventional golf tees is well known. The conventional tee has a concave head, on which a golf ball may be placed, and a body, usually ending in a point to enable the tee to be driven into the ground. Before striking the golf ball, the golfer first pushes a golf tee into the ground and then places a golf ball on the concave surface of the tee.

Moreover, the head of a conventional golf tee is perfectly round and not grooved. Because the head is round and does not contain a groove, its shape does not increase the likelihood that the golf ball will travel in any particular desired trajectory. Accordingly, there remains a need in the art for golf tees that provide directional trajectory to the ball following impact with a club. The present application fills that need.

SUMMARY

It is an objective of the application to provide a golf tee that provides directional trajectory to the ball, for increased accuracy.

It is another objective of the application to provide a golf tee that increases back spin of the golf ball.

It is also an objective of the application to provide a golf tee that is easy to manufacture.

Additional features and advantages of the application will be set forth in the description that follows, and in part will be apparent from the description, or may be learned by practice of the application. The objectives and other advantages of the application will be realized and attained by the structure particularly pointed out in the written description and claims hereof as well as the drawings.

To achieve these and other advantages and in accordance with the purpose of the application, as embodied and broadly described, a golf tee for use with a golf ball comprises a body having two ends, one end including a tip, and an elongated head connected to the other end of the body at a distance away from the tip, wherein the head includes a groove.

According to one aspect of the present application, the elongated head of the golf tee is concave. According to another aspect, the elongated head is tapered. According to further embodiments, the elongated head and/or the body are tapered to a pointed tip.

In one embodiment, a golf tee according to the application is made of a single material, such as wood, metal, or plastic. In another embodiment, the golf tee is made of a combination of materials.

It is to be understood that both the foregoing general description and the following detailed description are exemplary and are intended to provide a further explanation of the application as claimed.

BRIEF DESCRIPTION OF THE DRAWINGS

The accompanying drawings, which are included to provide a further understanding of the application and are incorporated in and constitute a part of this specification, illustrate embodiments of the application and, together with the description, serve to explain the principles of the application.

FIG. 1 illustrates a perspective view of a golf tee according to one embodiment.

FIG. 2 illustrates a view substantially from the top of the golf tee of FIG. 1.

FIG. 3 illustrates a view substantially from the side of the golf tee of FIG. 1.

DETAILED DESCRIPTION

With reference to the drawings, and in particular to FIGS. 1-3, a golf tee embodying the principles and concepts of the present application is described below.

FIG. 1 illustrates a perspective view of a golf tee according to a first embodiment of the present application. According to the first embodiment, the golf tee includes a body 110 having a tip 120 at one end and an elongated head 130 connected to the body 110 at a distance away from the tip 120. The elongated head 130 includes a concave top surface 132 for receiving a golf ball thereon, and the center of the concave top surface 132 includes a groove 140. Moreover, the elongated head 130 is tapered and ends in a pointed tip 150, located at a distance away from the portion that receives the golf ball.

Although, in FIG. 1, the upper portion of the body 110 is wider than the lower portion, the body 110 may be formed of an elongated shaft having a substantially uniform cross-section throughout.

The golf tee is made of plastic, metal, wood, or other suitable materials known to one of ordinary skill in the art. The golf tee may be made of a single material, or it may be made of a combination of materials.

FIG. 2 shows a view of the golf tee of the present application substantially from the top, showing the elongated head 130 that includes a groove 140 in the center of the concave top surface 132. The tapering of the elongated head, ending in the substantially pointed tip 150, is clearly visible in this view. The body 110 is also visible.

FIG. 3 shows a view of the golf tee of the present application substantially from the side, demonstrating the body 110 and the elongated head 130. A side view of the concave top surface 132 of the elongated head 130 is also shown.

Although certain presently preferred embodiments of the application have been described herein, it will be apparent to those of skill in the art to which the application pertains that variations and modifications of the described embodiment may be made without departing from the spirit and scope of the application. Accordingly, it is intended that the application be limited only to the extent required by the following claims and the applicable rules of law.

I claim:

1. A golf tee, comprising:

a body having two ends, one end including a tip; and an elongated head having two ends connected to the other end of the body at a distance away from the tip, wherein the elongated head is rounded and closed at one end and tapered to a single pointed tip at the other end, and wherein the elongated head includes a concave top surface for receiving a golf ball, the center of the concave top surface including a groove that runs continuously without obstruction from the rounded, closed end to the single pointed tip.

2. The golf tee of claim 1, wherein the body is tapered to a pointed tip.

3. The golf tee of claim 1, wherein the golf tee is made of a single material.

4. The golf tee of claim 1, wherein the golf tee is made of a combination of materials.

5. The golf tee of claim 1, wherein the golf tee is made of wood.

6. The golf tee of claim 1, wherein the golf tee is made of plastic.

7. The golf tee of claim 1, wherein the golf tee is made of metal.

* * * * *